US005615426A

United States Patent [19]

Hokett

[11] Patent Number: 5,615,426

[45] Date of Patent: Apr. 1, 1997

[54] PATIENT LIFT SHEET

[76] Inventor: Margaret D. Hokett, 1823 A Jenkins Rd., Chattanooga, Tenn. 37421

[21] Appl. No.: 489,738

[22] Filed: Jun. 13, 1995

[51] Int. Cl.[6] ..... A61G 1/00

[52] U.S. Cl. ..... 5/89.1; 5/486; 5/83.1

[58] Field of Search ..... 5/81.1 R, 89.1, 5/83.1, 86.1, 486, 482; 294/140

[56] References Cited

U.S. PATENT DOCUMENTS

| | | | |
|---|---|---|---|
| 1,971,294 | 8/1934 | Bunker | 5/89.1 |
| 2,793,768 | 5/1957 | Schaedler | 5/83.1 |
| 3,859,677 | 1/1975 | Nordwig | 5/89.1 |
| 3,884,225 | 5/1975 | Witter | 5/81.1 |

FOREIGN PATENT DOCUMENTS

| | | | |
|---|---|---|---|
| 8094 | 7/1933 | Australia | 5/89.1 |
| 522216 | 6/1940 | United Kingdom | 5/482 |

*Primary Examiner*—Flemming Saether

*Attorney, Agent, or Firm*—Jacobson, Price, Holman & Stern, PLLC

[57] ABSTRACT

A patient lift sheet of generally rectangular plan shape is provided and includes a pair of lifting bars removably supported therefrom at points spaced longitudinally along each opposite side longitudinal margin of the lift sheet. Each anchor bar defines a pair of longitudinally spaced anchor points thereon to which the lower ends of individually adjustable lifting or tension member straps are anchored. Further, the lift sheet includes an inner panel of brushed cotton and an outer panel of synthetic mesh material and the inner surfaces of the outer margins of the lift sheet have fleece panel strips disposed thereover.

8 Claims, 3 Drawing Sheets

PATIENT LIFT SHEET

BACKGROUND OF THE INVENTION

1. Field of the Invention

This invention relates to a lift sheet for lifting patients to and from a bed. The lift sheet itself is constructed in a manner to provide more comfort to the patient both while lying upon the sheet and during the process of lifting the patient to and from a bed. In addition, the lift sheet is further constructed in a manner whereby a patient, while being supported from the sheet during lifting to and from a bed, will be more fully supported and supported in a more relaxed condition.

2. Description of Related Art

Various different forms of lift sheets heretofore have been provided with the most common currently used lift sheet being illustrated, in use, in FIG. 7 of the drawings and with details of the manner in which a lift bar is supported from the most commonly used lift sheet illustrated in FIG. 8 of the drawings.

The prior art patient lift sheet illustrated in FIGS. 7 and 8 provides the necessary structure for lifting a patient to and from a bed, but lacks in structure for fully supporting the associated patient in a comfortable position and further lacks in structure for comfortable support of a patient lying upon a bed with the prior art lift sheet between the patient and the bed.

SUMMARY OF THE INVENTION

The lift sheet of the invention is of multi-ply construction designed to provide maximum comfort to an associated patient while the patient is lying upon a bed with the lift sheet between the patient and the bed and is further constructed in a manner such that the patient is fully supported in a comfortable position by the lift sheet during the process of lifting the patient to and from a bed. Furthermore, the lift sheet is also constructed in a manner such that the four lift bars thereof may be readily removed from the lift sheet before and reinstalled to the lift sheet after washing and drying of the latter.

The main object of this invention is to provide a lift sheet which will be comfortable to the patient while lying upon the lift sheet and yet which will provide sufficient ventilation to the surfaces of the patient supporting his or her weight upon the lift sheet while the latter is on a bed.

Another object of this invention is to provide a lift sheet constructed in a manner such that an associated patient will be more fully and comfortably supported during usage of the lift sheets in lifting a patient from or to a bed.

Still another object of this invention is to provide a lift sheet including four lift bars supported therefrom to be used while lifting the patient and with the lift bars being removably supported from the lift sheet in a manner such that the bars may be readily removed from and reinstalled to the lift sheet with little effort.

A final object of this invention to be specifically enumerated herein is to provide a patient lift sheet in accordance with the preceding objects and which will conform to conventional forms of manufacture, be of simple construction and easy to use so as to provide a device that will economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
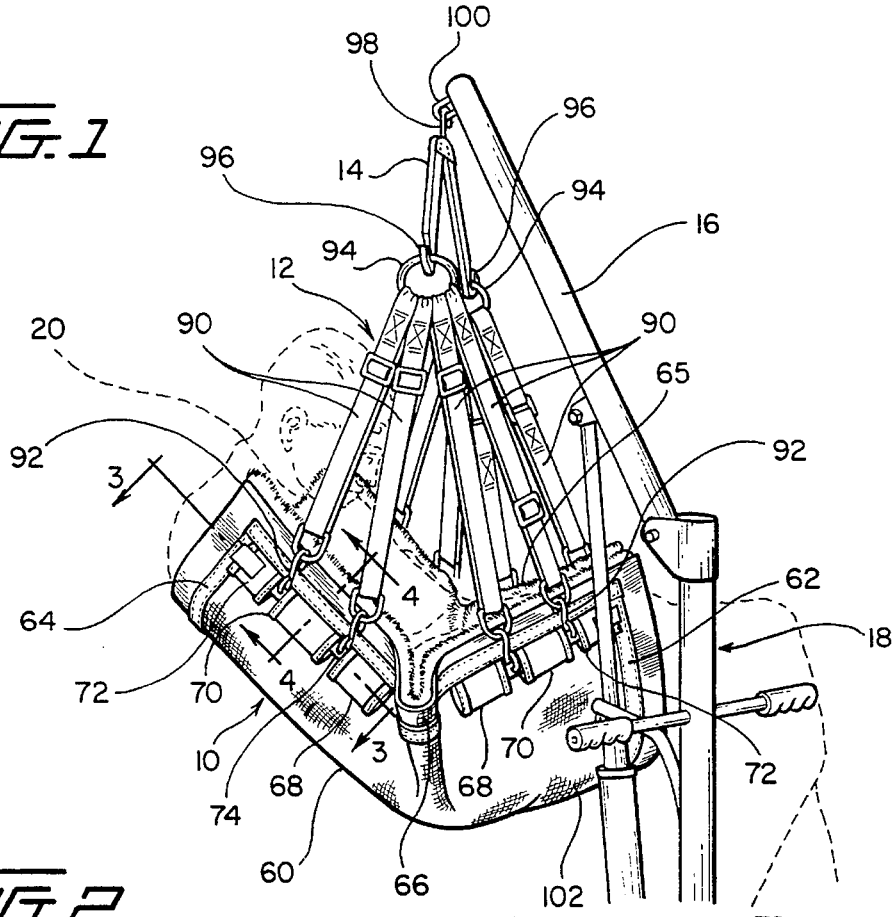
FIG. 1 is a perspective view of a preferred form of patient lift sheet constructed in accordance with the present invention and with the lift sheet being utilized to suspend an associated patient (illustrated in phantom lines) from a typical hoist through the utilization of an adjustable harness.

Referring now specifically to the drawings the numeral 10 generally designates a patient lift sheet constructed in accordance with the present invention and the numeral 12 generally designates an adjustable harness releasably anchored to the patient lift sheet 10 and utilized in supporting the latter from a suspension hook structure 14 releasably supported from the boom 16 of a hydraulic patient lift referred to in general by the reference numeral 18.

As may be seen from FIG. 1 of the drawings a patient 20 is supported from the lift sheet 10 in a seated, semireclinding comfortable position with opposite end portions of the lift sheet 10 extending beneath the thighs of the patient 20 and beneath the upper back of the patient 20.

Figure 7:
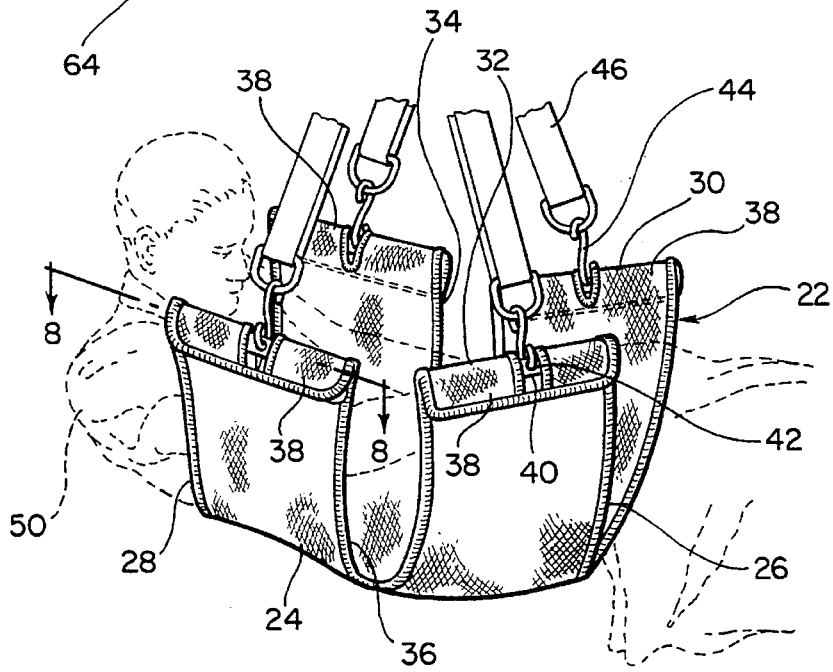
FIG. 7 (PRIOR ART)
FIG. 7 is a perspective view of a conventional form of patient lift sheet supporting a patient in phantom lines.

FIG. 7 illustrates a conventional form of lift sheet referred to in general by the reference numeral 22. The conventional lift sheet comprises a synthetic material mesh panel 24 having opposite ends 26 and 28 and opposite side margins 30 and 32. The margins 30 and 32 include outwardly opening notches 34 and 36 formed therein and the opposite ends of each of the margins 30 and 32 have notched hems 38 formed therein. Each of the hems 38 includes an elongated lift bar 40 disposed therein having a central aperture 42 formed therethrough and each aperture 42 has a hook 44 engaged therewith. Each of the hooks 44 is supported from the lower end of an adjustable length strap or tension member 46.

It is to be noted that the upper ends of the tension members extending upward from opposite side margins of the panel 24 are anchored to a ring member (not shown) releasably engaged with lower hook portions of a suspension hook structure, similar to the suspension hook structure 14, whereby the panel 24 may be utilized to lift the associated patient 50 in FIG. 7 to and from a bed (not shown) through the utilization of a hydraulic patient lift similar to that shown at 18 in FIG. 1.

Figure 8:
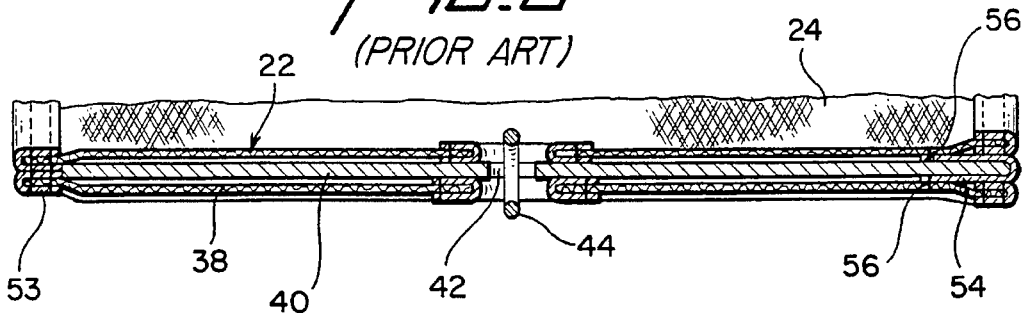
FIG. 8 (PRIOR ART)
FIG. 8 is an enlarged sectional view taken substantially upon the plane indicated by the section line 8—8 of FIG. 7.

With attention now invited more specifically to FIG. 8, it will be seen that each hem 38 of the panel 24 is sewn closed at one end as at 52 and closed at its other end through the utilization of a fabric loop 54 sewn within the corresponding hem 38 as at 56 and closely embracing the adjacent end of the corresponding lift bar 40. Thus, the fabric loop 54 removably encloses the lift bar 40 within the hem 38.

In order to remove the lift bar 40 from the hem 38, the hook 44 is first removed and the fabric loop 54 is downwardly, or upwardly, displaced by a finger inserted in the adjacent end of the hem 38 in order to laterally displace the closed end of the look 54 out of registry with the adjacent end of the lift bar 40. Then, the lift bar 40 may be withdrawn outwardly from the end of the hem 38 previously closed by the loop 54.

In use, it has been found that it is quite difficult to sufficiently laterally displace the loop 54 in order to enable withdrawal of the lift bar 40 from the hem 38. In addition, inasmuch as the hooks 44 are engaged through the apertures or openings 42 at the longitudinal midportions of the bars 42, little stability is provided the bars 40 supported from the hooks 44 and the bars 40 may have either end thereof inclined upwardly, or downwardly, according to the weighting of the patient 50 on various portions of the panel 24. For this reason, it may be seen that the patient 50 in FIG. 7 has little support for his upper back and he is supported in a substantially horizontal position between his lower back and his thighs.

On the other hand, as will be hereinafter more fully set forth, the lift bars of the lift sheet 10 of the instant invention each have two adjustable length strap or tension members anchored thereto and, accordingly, the patient 20 supported from the lift sheet 10 may be more comfortably supported in a reclining, partially seated position.

With attention now invited more specifically to FIG. 1, the patient lift sheet 10 includes a panel 60 including opposite end portions 62 and 64 and opposite longitudinal margins 65 and 66. Each end portion of each longitudinal margin includes a set of three longitudinally aligned and spaced apart loops 68, 70 and 72. Each set of loops serves generally the same purpose as the hems 38 on the prior art panel 24 illustrated in FIG. 7 and supports therein an elongated lift bar 74.

Figure 2:
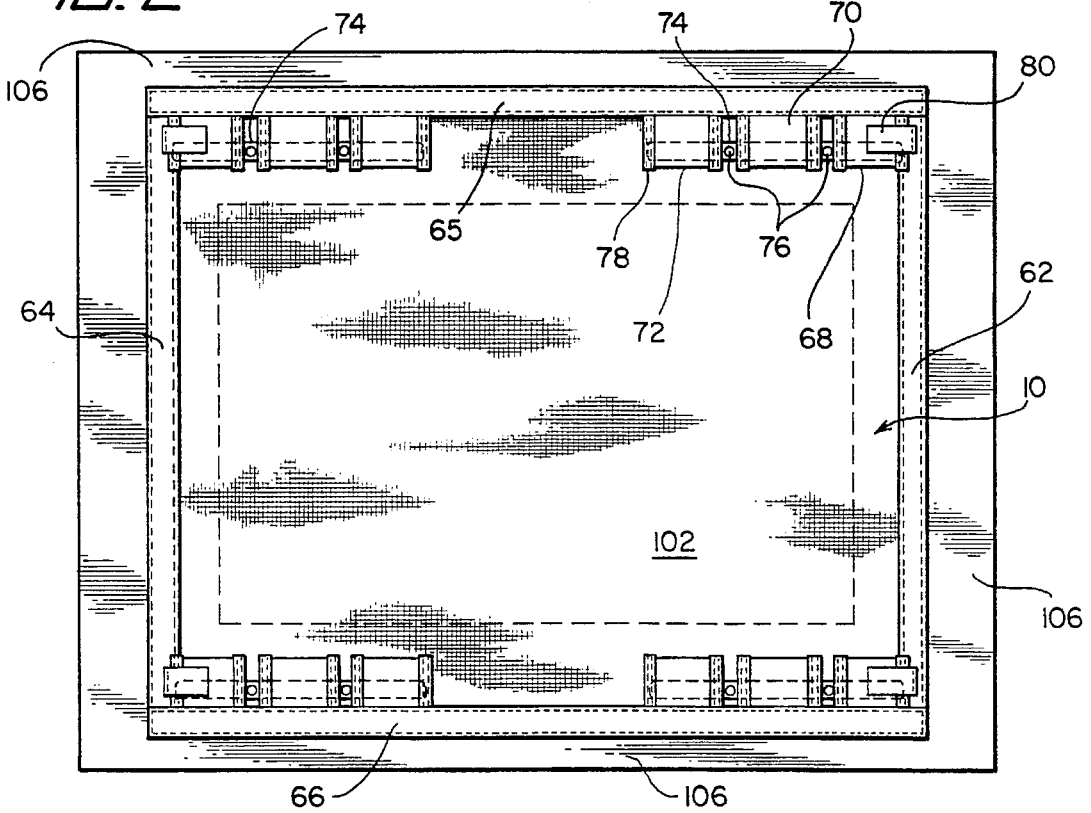
FIG. 2 is a plan view of the outer side of the patient lift sheet.
Figure 3:
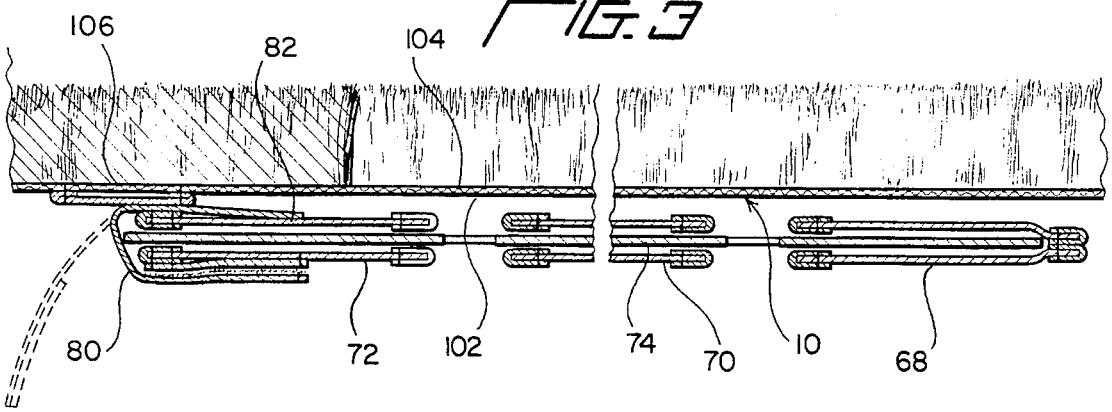
FIG. 3 is a fragmentary enlarged sectional view taken substantially upon the plane indicated by the section 3—3 of FIG. 1 and with the hooks of the suspension harness omitted.
Figure 4:
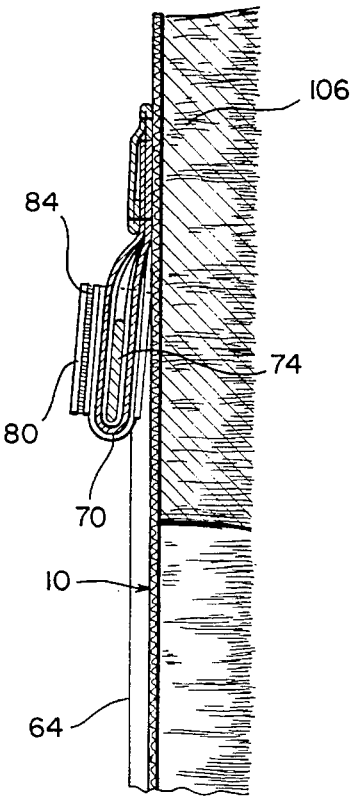
FIG. 4 is a fragmentary enlarged sectional view taken substantially upon the plane indicated by the section line 4—4 of FIG. 1.
Figure 5:
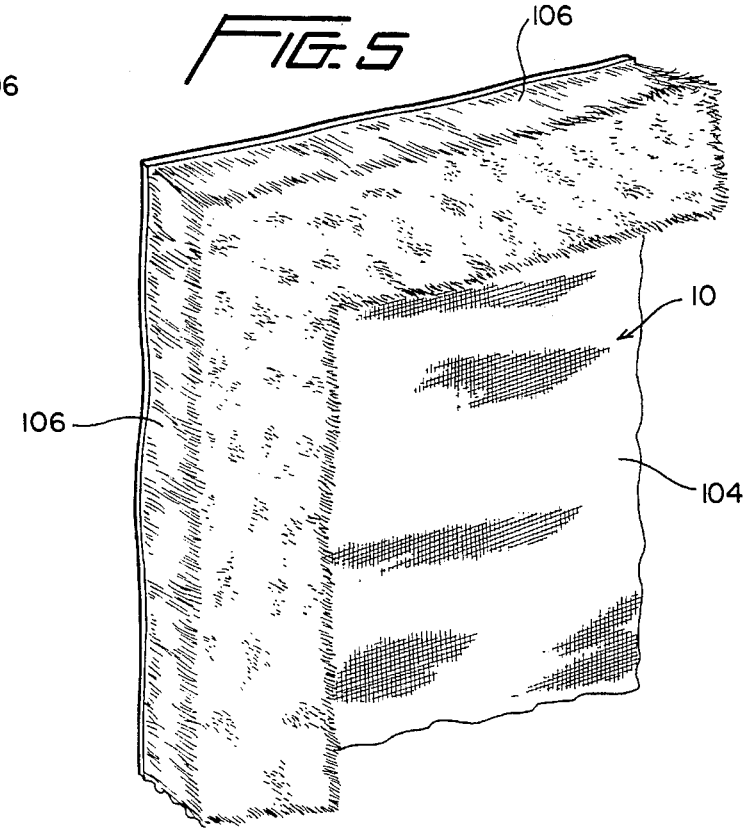
FIG. 5 is a fragmentary perspective view of one corner portion of the inner side of the lift sheet.
Figure 6:
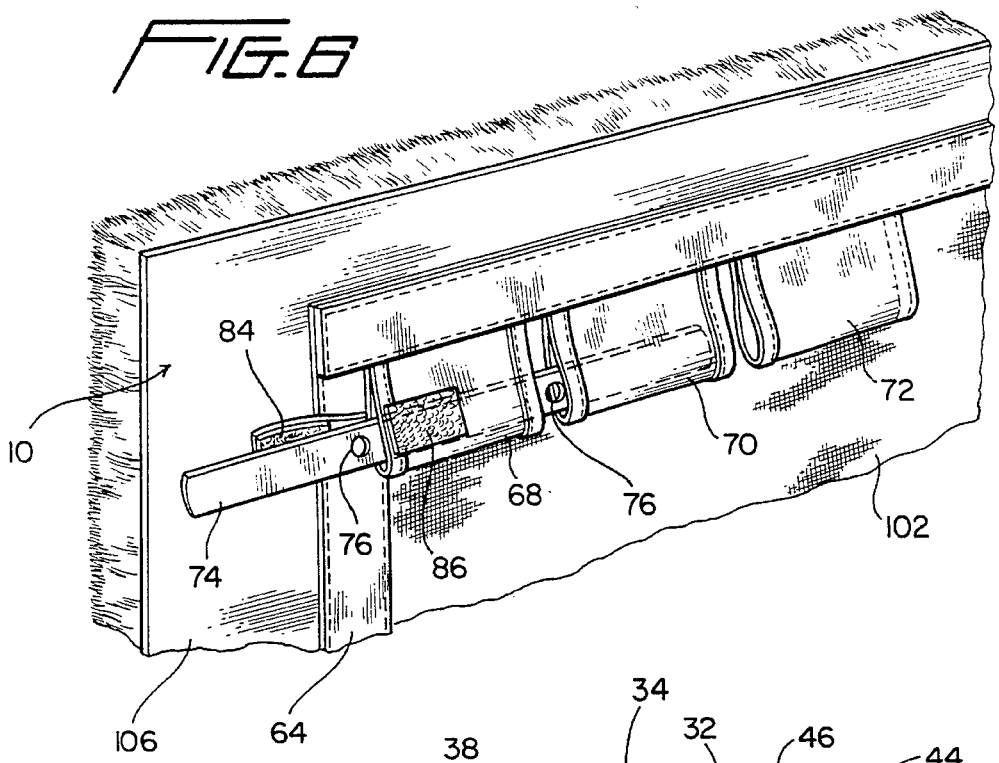
FIG. 6 is a fragmentary perspective view of the outer side of one corner portion of the lift sheet and with the associated lift bar being removed.

However, with attention now invited more specifically to FIG. 2, each lift bar includes a pair of longitudinally spaced apertures or openings 76 formed therethrough registered with the spaces between the corresponding center loop 70 and the adjacent loops 68 and 72. Further, each loop 72 is closed at its end remote from the corresponding loop 70 by stitching as at 78 and each loop 68 includes a retaining loop or strip 80 secured at one end by stitching as at 82, see FIG. 3, and including a pile strip 84 on its other end free, the outer side of the loop 68 including a loop strip 86 secured thereto, see FIG. 6. The free end of the loop 80 thus may have its pile strip 84 releasably anchored relative to the corresponding loop strip 86 in order to removably close the end of the loop 68 remote from the adjacent loop 70. In this manner, the associated lift bar 74 is retained within the corresponding sets of loops 68, 70 and 72, but may be readily removed therefrom.

From FIG. 1 of the drawings it may be seen that the harness 12 includes four pairs of adjustable length strap or tension members 90 having hooks 92 supported from their lower ends engaged through the corresponding apertures or openings 76. The upper ends of the straps or tension members 90 anchored to each side margin of the panel 60 are anchored relative to a lifting ring 94 and the lifting rings 94 are removably engaged with hook portions 96 carried by the lower ends of the legs of the inverted V-shaped suspension hook structure 14, the latter including an upper hook 98 removably engaged with an eye 100 supported from the free end of the boom 16, see FIG. 1.

At this point, it may be seen that the straps or tension members 90 may be effectively adjusted in length so as to support the inclined lift bars 74 in precisely the inclined positions thereof which will maintain the patient lift sheet 10 in the configuration illustrated in FIG. 1 when the patient 20 is supported from the patient lift sheet 10. In this configuration, the patient 20 is supported in a seated, semireclined position and has substantially all of his body, except from his lower legs, comfortably supported from the lift sheet 10. Further, it will be noted that the loops 80 may be readily opened for removal of the corresponding lift bars without possible finger injury of the person removing the lift bars 74.

The overall construction of the panel 24 includes an outer mesh sheet 102 of synthetic material and an inner sheet 104 of brushed, cotton material. Still further, the outer periphery of the lift sheet 10 is bordered by fleece panel strips 106 extending outwardly beyond the periphery of the lift sheet 10 and inwardly over the inner surface of the outer margin of the inner sheet 104. The fleece panel strips 106 are provided over the inner surfaces of the outer periphery of the lift sheet 10 in order to provide comfort to the patient in the areas of the lift sheet 10 from which the lift bars 74 are supported and also to shield the patient 20 against contact with the lower ends of the adjustable strap or tension members 90 and the hooks 92. By constructing the outer panel of the lift sheet 60 of synthetic mesh material and the inner sheet of brushed cotton material the weight of the patient is supported by the brushed cotton material (breathable) backed by the mesh panel 60 and does not directly contact the mesh panel 60.

It is pointed out that the patient 20 may in fact be disposed on a bed (not shown) for extended periods of time with the lift sheet 10 disposed between the patient and the bed. Accordingly, the "breathability" of the patient lift sheet is imperative and is carried out by the provision of the mesh panel 60 and the brushed cotton sheet 104. Furthermore, when the hooks 92 are disengaged from the lift bars 74 the patient 12 is protected from contact with the "lumpy" margins of the patient lift sheet 10 which are overlapped by the fleece panel sheet 106.

Thus, the lift panel sheet 10 retains its "breathability" and cushions contact between the patient 10 and any "lumpy" longitudinal marginal portions of the lift sheet 10. In addition, by suspending each of the lift bars 74 through the utilization of a pair of hooks 92 spaced longitudinally therealong to which the lower ends of the adjustable length straps or tension members 90 are anchored, the angulation of the individual lifting bars 74 may be readily adjusted as desired. Furthermore, the lifting bars 74 may be readily removed from the loops 68, 70 and 72 preparatory to washing the patient lift sheet 10.

The foregoing is considered as illustrative only of the principles of the invention. Further, since numerous modifications and changes readily will occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A patient lift sheet assembly including a flexible lift sheet member having opposite side longitudinal margins and opposite end margins, each longitudinal margin including at least two elongated, longitudinally spaced and extending lifting bars substantially stationarily supported therefrom, each of said lifting bars including at least two lifting member anchor points spaced apart longitudinally therealong and at least two upstanding tension members for each lifting bar, each tension member having upper and lower ends, the lower end of each of said tension members being anchored relative to a corresponding anchor point of the associated lifting bar, the upper ends of said tension members being suitably anchored to a single anchor member for support from and lifting and lowering by a lift structure, each of said tension members including adjustment structure operative to adjust the effective length thereof.

2. The lift sheet assembly of claim 1 wherein each of said longitudinal margins includes opposite ends sets of three longitudinally spaced support loops anchored relative thereto, each set of loops receiving opposite end and longitudinal central portions of the corresponding lifting bar therein, said anchor points of each lifting bar being disposed between said opposite end and longitudinal central portions.

3. A flexible patient lift sheet including opposite longitudinal side margins and opposite transverse end margins, each of said side margins including two opposite end sets of three longitudinally spaced loops each for a total of six loops along each longitudinal side margin, a seperate elongated lift bar received in each set of loops and defining a pair of lifting member anchor points spaced longitudinally therealong registered with the spacing between the center loop of the corresponding set of loops and the adjacent loops thereof.

4. The lift sheet of claim 3 wherein one of said adjacent loops of each set of loops includes a permanently closed end remote from the other adjacent loop, and closure structure removably closing the end of said other adjacent loop remote from said one adjacent loop, each closure structure including an elongated flexible strip having one end anchored to one side of the corresponding loop and a free end projecting outwardly of and deflected across the corresponding open end, said free ends each being lapped over the other side of the corresponding loop, said free ends and other sides including coacting loop and pile fastening structure removably fastening said free ends to said other sides.

5. A flexible patient lift sheet including opposite longitudinal side margins and opposite transverse end margins, which comprises a sheet of woven natural fiber and including inner and outer sides, said outer side being backed by a mesh sheet of synthetic fiber, said inner side having an inwardly facing synthetic fleece strip border secured thereover and extending about the marginal edges only of said sheet, said longitudinal margins each including a pair of elongated, longitudinally spaced and longitudinally extending lift bars removably stationarily supported therefrom equipped with longitudinally spaced lifting member anchor points to which the lower ends of a plurality of adjustable length upstanding lifting tension members may be secured.

6. The patient lift sheet of claim 5 wherein each longitudinal margin includes a pair of opposite end sets of three longitudinally spaced loops, each set of loops having one of said lift bars supported therefrom, each of said lift bars defining a pair of lifting member anchor points spaced longitudinally therealong and registered with the spacing between the center loop of the corresponding set of loops and the adjacent loops thereof.

7. The patient lift sheet of claim 5 including a pair of upstanding tension members for each lifting bar, each tension member having upper and lower ends, the lower end of each of said tension members being anchored relative to the corresponding anchor point of the associated lifting bar, the upper ends of said tension members being suitably anchored to a single anchor member for support from and lifting and lowering by a lift structure.

8. The patient lift sheet of claim 7 wherein each of said tension members includes adjustment structure operative to adjust the effective length thereof.

* * * * *